US005562987A

United States Patent [19]

Shimizu

[11] Patent Number: 5,562,987

[45] Date of Patent: Oct. 8, 1996

[54] HIGH STRENGTH FIBER OF POLYTETRAFLUOROETHYLENE AND A METHOD FOR MANUFACTURING THE SAME

[75] Inventor: Masazumi Shimizu, Mito, Japan

[73] Assignee: Hitachi Cable, Ltd., Tokyo, Japan

[21] Appl. No.: 450,875

[22] Filed: May 26, 1995

[30] Foreign Application Priority Data

May 31, 1994 [JP] Japan ..... 6-118824
Nov. 7, 1994 [JP] Japan ..... 6-271958

[51] Int. Cl.[6] ..... D02G 3/00

[52] U.S. Cl. ..... 428/364; 428/394; 428/422; 57/700; 57/907

[58] Field of Search ..... 428/422, 364, 428/394; 57/200, 907; 264/147

[56] References Cited

U.S. PATENT DOCUMENTS 2,776,465 1/1957 Smith .
4,064,214 12/1977 Fitzgerald ..... 264/147
4,096,227 6/1978 Gore ..... 264/210
5,061,561 10/1991 Katayama ..... 428/364
5,209,251 5/1993 Curtis et al. ..... 132/321

OTHER PUBLICATIONS

Journal of Polymer Science: Polymer Physics Edition vol. 20, 751–761 (1982).

Journal of Polymer Science: The Density of Amorphous PTFE vol. 20, 2159–2161 (1982).

*Primary Examiner*—Newton Edwards
*Attorney, Agent, or Firm*—Antonelli, Terry, Stout & Kraus

[57] ABSTRACT

The present invention provides high strength fiber of polytetrafluoroethylene (PTFE) having a strength of at least 0.5 GPa, which is manufactured by forming a monofilament of PTFE group polymer by paste extrusion, free end annealing the monofilament, and subsequently drawing the annealed monofilament to form the fiber, wherein PTFE molecular chains are oriented in a direction parallel to an axial direction of the fiber.

4 Claims, 1 Drawing Sheet

HIGH STRENGTH FIBER OF POLYTETRAFLUOROETHYLENE AND A METHOD FOR MANUFACTURING THE SAME

BACKGROUND OF THE INVENTION (1) Field of the Invention

The present invention relates to high strength fiber of polytetrafluoroethylene (called PTFE hereinafter) having a strength of at least 0.5 GPa, and a method for manufacturing the same, further, ultra high strength fiber of PTFE having a strength of at least 1.0 GPa, and a method for manufacturing the same.

(2) Description of the Prior Art

PTFE is one of fluorine resins, and FEP (tetrafluoroethylene-hexafluoropropylene copolymer), PFA (tetrafluoroethylene-perfluoroalkoxy Group copolymer), and ETFE (tetrafluoroethylene-ethylene copolymer) are included in the fluorine resins.

Each of the above described fluorine resins has superior heat resistance, chemical resistance, water and moisture resistance, electric insulating property, and incomparable non-adhesiveness and surface wear resistance. Among the above fluorine resins, PTFE has most preferable heat resistance, chemical resistance, and water and moisture resistance. Accordingly, PTFE fiber also has the same preferable feature as the above described feature of PTFE resin itself. PTFE fiber is manufactured and sold by American Du Pont Co. and Japanese Toray Fine Chemicals Co. Details of their methods for manufacturing PTFE fiber are not known, but characteristics of PTFE fiber manufactured by each of the above companies does not have significant difference mutually.

Smith et al. (U.S. Pat. No. 2,776,465) disclosed highly oriented shaped tetrafluoroethylene article and process for producing the article. Smith et al taught PTFE fiber obtained by drawing a PTFE monofilament formed by paste extrusion after heat treatment at a temperature higher than crystal melting point of PTFE. As far as the above steps of operation, the disclosure by Smith et al is identical with the present invention. However, Smith et al did not teach any of the free end anneal (FEA) of PTFE monofilament, which is the key operation of the present invention. Accordingly, strength of the PTFE fiber obtained by the Smith et al's disclosed process is as low as approximately 2.4 g/d (0.45 GPa) (Example IX).

Katayama (U.S. Pat. No. 5,061,561) disclosed yarn articles comprising a tetrafluoroethylene polymer and a process for producing the article. Katayama taught a PTFE fiber having a tensile strength in a range 4–8 g/d (0.74–1.49 GPa) (col.5, lines 28–32). However, the PTFE fiber is obtained by drawing porous PTFE material comprising nodes connected by fibrils as a starting material at a temperature higher than melting point of PTFE crystal. Therefore, the PTFE fiber by Katayama is obtained by an entirely different process from the present invention.

The porous PTFE material, the raw material, is obtained by the process described in col. 5, line 65 col. 6, line 8 in the reference (U.S. Pat. No. 5,061,561). The porous PTFE material itself is expensive, and PTFE fiber obtained by manufacturing of the porous PTFE material is naturally more expensive.

Generally speaking, a mechanical strength of PTFE fiber is rather at a lower level as fiber than the maximum level. Among various fibers of fluorine resins, the mechanical strength (GPa) of PTFE fiber is approximately 0.16, and is slightly larger than those of FEP (0.04) and PFA (0.07) but inferior to that of ETFE (0.25).

Comparing with general fibers made from materials other than fluorine resins, difference in the mechanical strength is significant, for instance, such as high strength string of nylon (0.7), high strength string of polypropylene (0.66), and high strength string of polyester (0.55).

The fact that the mechanical strength of PTFE fiber is far inferior to that of other general fiber is considered to be one of the serious problems which prohibits PTFE fiber from being used in wider utilizing fields in consideration of the most preferable feature such as aforementioned heat resistance, chemical resistance, and water and moisture resistance.

Further, currently, high strength fibers or ultra high strength fibers made from various materials which are extending gradually a variety of kinds have been developed. Although there are other terms such as high elastic or ultra high elastic fibers, these fibers are almost similar with the above high strength or ultra high strength fibers. Therefore, only the high strength or ultra high strength fiber is restrictively used in this specification as for the term including the high elastic or ultra high elastic fiber.

General definition for the high strength or ultra high strength is not established. However, in this specification, a fiber which can guarantee a mechanical strength of approximately 0.5 GPa is called the high strength fiber, and a fiber which can guarantee a mechanical strength of at least 1 GPa is called the ultra high strength fiber.

Considering raw materials for the high strength or ultra high strength fiber by dividing conventionally the raw materials into two categories such as a bending chain polymer and a rigid linear chain polymer, only three polymers such as polyethylene of the bending chain polymer, and aramid and polyallylate of the rigid linear chain polymer are considered to be suitable for the raw materials, and further, if the raw materials are restricted to polymers for general use, only polyethylene is considered to be appropriate.

As commercial products, "Kevlar" (made by E. I. du Pont de Nemours & Co.) and "Technola" (made by Teijin Co.) of aramid group, "Vectran" (made by Kurare Co.) of polyallylate, and "Dynima" (made by Toyobo Co,), "Techmiron" (made by Mitsui Sekiyu Chemical Co.), and "Spectra" (made by Allied Chemical Corp.) of polyethylene group are available.

The above mentioned commercially available (ultra) high strength fibers have the following problems. First, polyethylene (ultra) high strength fiber has poor heat resistance. On the contrary, (ultra) high strength fibers of aramid and polyallylate are superior to polyethylene in heat resistance, but are generally inferior in water resistance which is very important in practical use, especially in hot water resistance, as a common defect of polymers obtained by a condensation polymerization.

Further, as for a common problem for all of the (ultra) high strength fibers, expensiveness is pointed out. The reason of expensiveness can be considered as a cost-up caused by, in cases of aramid and polyallylate, their very special raw material monomers which necessitate to be synthesized especially, and in case of polyethylene, an expensive new investment in manufacturing facility and a problem such as a slow speed of production. In consideration of the above problems, invention of an (ultra) high strength fiber, which has no aforementioned serious problems and can be manufactured from conventional monomers by a relatively simple process, has been expected from commercial markets.

SUMMARY OF THE INVENTION (1) Objects of the Invention:

In consideration of the above described problems of prior art, one of the objects of the present invention is to provide a high strength PTFE fiber having a strength of at least 0.5 GPa, and a method for manufacturing the same, and further, other one of the objects of the present invention is to provide a high strength PTFE fiber having a strength of at least 1 GPa, and a method for manufacturing the same.

(2) Methods of Solving the Problems:

In order to realize the above described objects of the present invention, the high strength PTFE fiber relating to the present invention is manufactured by a heat treatment under an expansible and shrinkable condition and a subsequent drawing process of PTFE polymer monofilament which is fabricated by a paste extrusion process. The high strength PTFE fiber relating to the present invention has a structure wherein molecular chains are arranged in parallel to a direction of the fiber axis.

Further, the high strength PTFE fiber relating to the present invention, which is manufactured by a drawing process of PTFE polymer monofilament fabricated by a paste extrusion process, has a diameter of at most 50 μm and a tensile breaking strength of at least 0.5 GPa.

A method for manufacturing the high strength PTFE fiber relating to the present invention comprises the steps of fabricating a monofilament of PTFE polymer by a paste extrusion process with PTFE billets, a heat treatment of the monofilament under an expansible and shrinkable condition, cooling gradually, and fabricating fibers by drawing of the monofilament.

Further, another method for manufacturing the high strength PTFE fiber relating to the present invention comprises the steps of fabricating a monofilament having a diameter of at most 0.5 mm by a paste extrusion process with PTFE polymer billets at a temperature of at least 30° C. and a reduction rate of at least 300, a heat treatment of the monofilament under an expansible and shrinkable condition at a temperature of at least 340° C., cooling gradually with a cooling rate of at most 5° C./min., and subsequently fabricating fibers by drawing of the heat treated monofilament at least 50 times long at a temperature of at least 340° C. and drawing speed of at least 50 mm/sec., and cooling at once after the drawing for forming PTFE fibers having a diameter of at most 50 μm.

The PTFE polymer billets are desirably fabricated by pressing moist fine powder of PTFE polymer which is previously moistened with an extrusion assistant agent. Preferably, the fine powder of PTFE has a particle diameter in a range from 0.1 μm to 0.5 μm.

The PTFE polymer used in the present invention is a polymer of TFE, i.e. tetrafluoroethylene, and preferably the polymer has a molecular weight of at least a several millions. The PTFE polymer can be a copolymer including less than a few percent of other kind of monomers as comonomers.

In order to form fibers by drawing, the fine powder of the polymer is previously fabricated to a monofilament having a diameter of at most about 0.5 mm by a conventional paste extrusion process. Optimum diameter of the fine powder particle for the paste extrusion is in a range from 0.1 μm to 0.5 μm, and the fine powder having the optimum diameter is synthesized by an emulsion polymerization or an irradiation polymerization. When a large reduction rate at the paste extrusion process is allowable as a result of copolymerization, the synthesis is desirably performed so as to satisfy the large reduction rate, because the objects of the present invention can be achieved preferably.

As for the extrusion assistant agent which is used as a lubricant necessary for extruding paste of the PTFE fine powder, a conventional lubricant used generally in industry can be adoptable. An amount of the extruding assistant agent used in the extruding process is generally in a range from 15 to 25%, but the amount is not necessarily restricted to the above range, and sometimes a more amount of the agent than the above range is used based on necessity for achieving a large reduction rate.

The extrusion assistant agent is generally an organic solvent of hydrocarbon group or one of the oil group solvents such as isopar-E, isopar-H, isopar-M (all made by Esso Chemical Co.), smoil P-55 (Matsumura Sekiyu Co.), kerosine, naphtha, Risella #17 oil, petroleum ether, and the like. A mixture of more than two kinds of extrusion assistant agents can be used.

Materials necessary for obtaining the high strength fiber of PTFE are only the above described PTFE as a polymer and the extrusion assistant agent necessary for the paste extrusion, and other gradients such as an oxidation inhibiter are not necessary.

Next, a method for fabricating high strength fiber of PTFE with the above described materials is explained hereinafter.

The method for fabricating high strength fiber of PTFE comprises the following seven steps;

(1) Sieving fine powder of PTFE (2) Blending an extrusion assistant agent with the fine powder of PTFE (3) Mixing, dispersing, moistening, and sieving (4) Preforming (billet forming)

(5) Paste-extrusion of monofilament (6) Heat treatment and cooling (7) Super drawing and cooling Among the above seven steps, the steps from (1) to (4) are almost the same as a general extrusion process for paste of PTFE fine powder conventionally performed.

The most important points for controlling fine structure of molecular arrangement of PTFE molecules, which are indispensable steps for fabricating super high strength fiber of PTFE and feature of the present invention, are last three steps, i.e. (5) Paste-extrusion of monofilament, (6) Heat treatment and cooling, and (7) Super drawing and cooling.

Hereinafter, content of the above each steps is explained in the order of the steps.

(1) Sieving fine powder of PTFE

Fine powder of PTFE has a typical cohesiveness, and easily forms a mass by vibration or self-weight during transportation and storage. The mass makes handling of the powder difficult, and disturbs moistening the powder with an extrusion assistant agent homogeneously. Further, if any mechanical force is applied in order to loosen the mass, the fine powder is easily changed to fiber by shear stress caused by the applied mechanical force, and the fiber effects disadvantageously to the extrusion. Accordingly, keeping the fine powder of PTFE in a loose condition before blending an extrusion assistant agent is very important. In order to keep the fine powder loose, it is necessary to make the fine powder pass through a sieve of 8 mesh or 10 mesh, each of which has holes of 2.0 mm in diameter or 1.7 mm in diameter, respectively. Desirably, the above sieving and weighing of the fine powder of PTFE are performed in a room wherein temperature is controlled below a room temperature transition point (about 19° C.) of PTFE.

(2) Blending an extrusion assistant agent with the fine powder of PTFE

A necessary amount of the sieved fine powder and an extrusion assistant agent are blended in a dried wide-mouthed bottle having a sufficient capacity with an air tight plug. In order to facilitate the blending, a space equal to ⅓–⅔ of the bottle capacity remains vacant. After the blending, the bottle is sealed air-tightly for preventing volatilization of the extrusion assistant agent.

(3) Mixing, dispersing, moistening, and sieving

After the blending, the sealed bottle is shaken slightly in order to disperse the extrusion assistant agent. Subsequently, the bottle is placed on a turntable and is rotated with an appropriate speed below 20 m/min. for about 30 minutes for blending and dispersing. The rotation speed is selected to be sufficient for blending and dispersing, but not too fast to make the fine powder fiber by shear stress. After the blending, the fine powder is keptat a room temperature for from 6 to 24 hours so as to be moistened with the extrusion assistant agent sufficiently to primary particles by penetrating through secondary particles of the fine powder. Subsequently, the blended fine powder is sieved to eliminate masses which are yielded by the blending.

(4) Preforming (billet forming)

An adequate apparatus for preforming is required in this process. A billet is fabricated by charging the moistened fine powder of PTFE, which is obtained by the previous process, into a cylinder of the apparatus for preforming, and compressing the fine powder with a ram. Necessary pressure for the compressing corresponds to the size of the cylinder, and generally a pressure in a range of 1 kg/cm$^2$–10 kg/cm$^2$ and several minutes retention are required. After fabricating, the billet must be transferred to the next paste-extrusion process as soon as possible in order to prevent the billet from escaping of the extrusion assistant agent. Because, the billet is fabricated with the fine powder of PTFE polymer which is moistened by the extrusion assistant agent, and the extrusion assistant agent remained in the billet after the fabrication facilitates the subsequent paste-extrusion of the billet to monofilament, and accordingly fabrication of the monofilament can be easily performed.

(5) Paste-extrusion of monofilament

A temperature condition for paste-extrusion of the PTFE fine powder relates intimately with PTFE crystal structure change depending on temperature. As it is well known in general, PTFE has a triclinic crystal system at below 19° C. The triclinic crystal system has a large deforming resistance, and accordingly, PTFE is not adequate for a deforming processing at a temperature far below the melting point of PTFE. At above 19° C., the crystal structure of PTFE has a hexagonal crystal system, and in accordance with raising the temperature, crystalline elasticity decreases and plastic deforming property increases because portions of random arrangement increase along a major axis of the crystal.

In accordance with the above facts, the temperature condition for the paste-extrusion of PTFE fine powder is desirably at least 30° C., and empirically a range from 40° C. to 60° C. is preferable.

Further, in order to perform the paste-extrusion effectively, it is important not to supply any load to the billet before the temperature of the billet is adjusted sufficiently to the preferable condition. If any load is supplied, not a negligible amount of billet remains in the cylinder without being extruded normally, and lowers a yield of production. Or if the remained billet is forced to be extruded, the obtained monofilament has a problem in the successive super drawing even if the monofilament is processed with the normal exact heat treatment.

The second important point is a reduction ratio (hereinafter called RR). The RR is a ratio of a cross sectional area of the cylinder of the extruder to a cross sectional area of the die. The RR is an important factor for a general conventional extrusion process, but especially important in manufacturing the PTFE super high strength fiber from PTFE polymer.

Fundamental of manufacturing the high strength fiber from PTFE polymer is in extending bonding angles among atoms which comprising main chains of the polymer and rotating angles of the each bonding as long as possible and arranging extremely the ultimately extended molecular chain along to a direction of the fiber axis.

Methods for achieving control of the above described fine structure varies depending on whether the molecular chain is a bending chain or a rigid straight chain. PTFE is usually classified as a bending chain type polymer as well as polyethylene. However, it has been found as a result of study in connection with the present invention that PTFE molecule actually behaves fairly like a polymer having the rigid straight chain, different from polyethylene molecule, because the PTFE molecule is rather a straight molecule having spiral structures. That means, the PTFE is a polymer which must be positioned at the middle of the bending chain type polymer and the rigid straight chain type polymer. However, PTFE is still a bending chain type polymer as well as ethylene, and a super drawing process for controlling the fine structure which is necessary for obtaining ultra high strength fiber is required.

The drawing of the PTFE fine powder begins actually from a paste-extrusion process. A substantial drawing rate $\lambda_0$ is expected to be expressed by the following equation (1);

$$\lambda_0 = RR \times \lambda \quad (1)$$

where, $\lambda$ is a drawing rate when the paste-extruded monofilament is super drawn by a drawer which is installed in a thermostatic chamber after being processed by a heat treatment in a free ends condition, that is, the heat treatment under a condition wherein either of expansion and shrinkage of the monofilament are freely allowed (called hereinafter Free End Anneal, FEA).

However, the monofilament shrinks in the heat treatment between a reduction process and the super drawing process. Therefore, although the above equation (1) is correct qualitatively and can be used for explaining a reversely proportional relationship between the RR and $\lambda_0$, the equation (1) is quantitatively incorrect.

The substantial drawing rate $\lambda_0$ necessary for obtaining the high strength fiber of PTFE is constant when a molecular weight of the PTFE is constant. Accordingly, the drawing rate $\lambda$ in a super drawing process relating to a specified PTFE decreases in accordance with the equation (1) when the RR of the PTFE monofilament increases. The above understanding is one of the important points for obtaining the high strength fiber from the PTFE monofilament.

The next important thing in consideration of a reduction ratio is a point that, if the reduction ratio differs, a finally identical arranged structure can not be obtained even if the substantial drawing rate $\lambda_0$ is the same. In order to achieve high strength fiberization of PTFE, it is necessary to obtain firstly PTFE monofilament having a large RR as possible. As a result, the strength is improved and stabilized even if drawing rate in the super drawing process decreases.

The reason of the above result is not sufficiently analyzed at the present, but if the larger the RR is in a range of free end annealing condition, the more the arranged structure of PTFE remains after the free end annealing. Therefore, the large amount of the remaining arranged structure can be assumed to influence advantageously to the ultimate arrangement of PTFE molecules obtained by the successive super drawing process. However, if the heat treatment is performed with a severer condition than that of the present invention, for instance, sintering at a higher temperature than 450° C. or at 370° C. for two hours, the arranged structure of PTFE disappears. Therefore, the RR at least 300, desirably at least 800 is required.

As previously described, a diameter of the PTFE monofilament for the super drawing is, although it depends on capacity of the drawer, utmost about 0.5 mm (if drawing velocity is faster, the larger diameter of the monofilament can be used). Therefore, even if the RR is selected as 3000, an inner diameter of cylinder in the drawer can be about 54 mm, and a small size drawer is usable.

Structure of a die for the drawing can be the same as the one for general paste-extrusion of PTFE. That is, a taper angle is in a range from 30° to 60°, and a land is chosen to be long enough so as to prevent torsion and kink.

(6) Heat treatment and cooling

The heat treatment condition is the most important factor in high strength fiberization of PTFE. Because, only the heat treatment condition makes the super drawing possible, gives a strength at least 0.5 GPa as the PTFE high strength fiber, and decides whether a homogeneous stable strength in an axial direction of the fiber can be guaranteed or not. In other words, PTFE can be super drawn easily, but, if the heat treatment condition is not adequate, there are many cases wherein an expected strength can not be obtained even if the super drawing is possible, or the strength in an axial direction of the fiber is not homogeneous nor stable. As for a severe heat treatment, a temperature and a time for the heat treatment, a cooling rate, and a temperature range for controlling the cooling rate constant must be defined clearly. Such severe heat treatment as above described is exactly required for the high strength fiberization of PTFE. Further, defining the above described conditions severely is not sufficient. The heat treatment necessary for the high strength fiberization of PTFE requires to define a dynamic condition in which the PTFE monofilament must be thermally treated.

That is, a dynamic condition in which the PTFE monofilament must be heat treated for obtaining the PTFE high strength fiber means a condition wherein the monofilament is made dynamically free. In the present specification, the above condition is expressed as free end anneal as previously described. Naturally, the free end anneal does not disturb any expansion and shrinkage of the monofilament in the heat treatment. If, on the contrary to the free end anneal, the monofilament is heat treated with fixing both ends of the monofilament firmly to be sagless, the treated monofilament can hardly be drawn. Accordingly, a drawing ratio decreases corresponding to constraints at both ends of the monofilament or partial stresses in the heat treatment. However, even both ends of the monofilament are fixed firmly, if a sag at least 20% (a slack) is given to the monofilament so as not to generate a stress by thermal shrinkage in the monofilament at the heat treatment, the condition can be regarded as free end anneal. This understanding is important when industrial manufacturing of the fiber is planned.

Regarding to the temperature and the time for the heat treatment, a condition at 350° C. for 30 minutes is the minimum required level. The heat treatment at 350° C. for 20 minutes is not sufficient for complete sintering. Desirably, at least 350° C. for 1.5 hours is necessary. However, 370° C. for more than 2 hours or higher than 450° C. is inadequate level because the arranged structure can not be remained after the heat treatment and subsequent cooling. The above described free end annealing makes the super drawing possible, which realizes an ultimate arrangement of PTFE molecules necessary for the high strength fiberization of PTFE.

Finally, a cooling condition after completion of the heat treatment of the PTFE monofilament, which is performed at the temperature and the time described above, is explained.

The reason of importance of the cooling rate, which has been described previously, is that the cooling rate determines crystallinity of the heat treated PTFE monofilament. The higher the degree of crystallinity is, the strength of the PTFE high strength fiber manufactured in the subsequent process becomes stronger, defects of the fiber in a longitudinal direction decreases, and fluctuation in strength of the fiber decreases remarkably.

It is generally well known that the degree of crystallinity of crystalline polymer especially depends on a cooling speed after the heat treatment at a temperature above its melting point. However, in a case of polymer, it is very rare that the degree of crystallinity resulted from the cooling speed controls a result of subsequent processing (super drawing) performed again at a temperature higher than its melting point.

In accordance with the above described reason, a slow cooling speed as possible is preferable. However, in order to guarantee a stable strength of industrially produced PTFE high strength fiber, the cooling speed must be controlled strictly. Accordingly, the cooling speed is explained hereinafter quantitatively.

Influence of cooling speed on the degree of crystallinity of PTFE monofilament was determined by a method wherein the monofilament was thermally treated first at 350° C. for 1.5 hours free end annealing, subsequently cooled with a designated speed from 350° C. to 150° C., and finally cooled down rapidly from 150° C. to room temperature. Then, the degree of crystallinity of the monofilament treated with the above procedure was determined from observed fusion enthalpy of DSC (Differential Scanning Calorimetry), taken 93 J/g as the fusion enthalpy of the complete crystalline PTFE (H. W. Starkweather, et al.: J. Polymer Sci. Polymer Phys. Edi., 20, 751–761 (1982)).

One of the reason why the degree of crystallinity of the PTFE varies depending on the cooling speed, and decreases remarkably to less than the crystallinity of fine powder (76.4%) by the heat treatment at a high temperature above its melting point is assumed that rearrangement of molecules of PTFE require a long time because molecular weight of PTFE is as large as 8.42 million.

The strength of the PTFE fiber larger than 0.5 GPa can be obtained by the cooling speed larger than 10° C./min. depending on a drawing ratio. However, the stable strength in a longitudinal direction can be obtained only by going slower than 5° C./min. Preferably, slower than 0.5° C./min. is desirable.

(7) Super drawing and cooling

In order to draw the PTFE monofilament experimentally, a thermostat furnished with a drawer is required. Only one process of the present invention which can not be seen in conventional processes for PTFE products by paste extrusion of PTFE fine powder is the drawing process.

In order to achieve the super drawing of PTFE, drawing conditions must be controlled strictly in the same way as the heat treating conditions, and a drawing apparatus is required to have an ability better than a required technical level.

The drawing apparatus is a thermostat furnished with a drawer, wherein a monofilament of PTFE is set between chucks of the drawer, the drawer is inserted into the thermostat, the monofilament of PTFE is drawn to a designated drawing ratio with a designated drawing speed by an external operation after the thermostat reaches a designated temperature, and the drawn monofilament with the chucks can be taken out from the thermostat outside at a room temperature after the drawing operation finished. Thermocouple are provided in the vicinity of the monofilament of PTFE between the chucks for indicating and controlling temperature at the vicinity within ±1° C., desirably within ±0.5° C. The drawer is required to have an ability to draw with a drawing speed at least 50 mm/sec., and preferably up to 10 times, i.e. 500 mm/sec.

A method for achieving super drawing of heat treated (free end annealed) monofilament of PTFE using the thermostat furnished with a drawer (drawing apparatus) having the above described capacity is explained hereinafter;

Diameter of the free end annealed monofilament for the experiment is desirably as thin as possible. When RR is at least 800, a strength at least 0.5 GPa can be obtained if the diameter of the fiber obtained by the super drawing equals to or less than about 70 μm. However, generally, a super high strength at least 1 GPa can hardly be obtained unless the diameter of the fiber equals to or less than about 50 μm. In order to obtain the fiber having a diameter equals to or less than about 50 μm with preferable reproducibility by the super drawing, a condition is required wherein RR is at least 800, and the diameter of the monofilament after the paste extrusion is at most 0.5 mm, desirably at most 0.4 mm. The reason for the above condition is assumed that, in addition to the orientation of PTFE crystals by the RR effect, monoaxial drawing in a strict meaning becomes impossible as a result of generating a non-uniform stress in a circumferential direction of the monofilament by cramping of the monofilament with the chucks when an initial diameter of the monofilament is thick. If the drawing is not precisely monoaxial, the diameter of the monofilament can not be reduced to, for example, at most 50 μm even if the monofilament can be super drawn by 25000% (250 times), nor a high strength of at least 0.5 GPa can often be obtained. The above described problem can be solved if a chuck enabling the drawing with a uniform external stress in a circumferential direction of the monofilament is used.

The free end annealed monofilament is cramped by the chucks of the drawer so that an axis of the monofilament becomes exactly parallel to the drawing direction, and inserted into the thermostat which is maintained at a designated temperature so that the temperature of the monofilament is raised to the designated temperature.

Generally, a heat capacity of the drawer itself is larger than that of the free end annealed monofilament. Therefore, although recovery of temperature drop by the insertion of the monofilament requires a somewhat long time, the monofilament is required to be kept in the thermostat about five more minutes after the temperature in the vicinity of the monofilament recovers the designated temperature.

Drawing temperature explained hereinafter is the most important one in the conditions for the super drawing. Generally, the drawing temperature is at least 360° C., and most preferably it is in a extremely narrow range such as 387° C. –388° C. The reason why such a narrow range is preferable is not clarified yet, but the inventor assumes that it depends on a difference in thermal stability of microstructure of the PTFE super high strength fiber formed by the super drawing.

As stated previously, the PTFE molecule is a high polymer having two characters, one is as a bending chain polymer like as polyethylene, and another is as a rigid linear chain polymer like as Kevlar (a commercial name of a product made by Du Pont Co., an aramid high strength fiber) group aramid. When PTFE ultra high strength fiber having an ultra high strength such as averaged 2 GPa is heated under crossed Nicol by 10° C/min., the fiber indicates a remarkable shrinkage at approximately 340° C., and subsequently, the fiber indicates visible light colors orderly such as yellow, green, blue, red, dark orange, light orange, and yellow at above 360° C. although the fiber is colorless and transparent until 350° C. The above region from red to light orange color is extended in a range from 380°–390° C., which coincides with a preferable condition for the super drawing. The monofilament obtained by free end annealing indicates approximately the same phenomenon depending on reduction ratio and thermal treatment conditions. However, monofilament obtained by constrained heat treatment does not indicates the phenomenon at all (naturally if the fiber is retained at above 350° C. for an adequate period, it is annealed with free end condition). The above described visible light colors are regarded as indicating existence of regular layered structure, and red color means the most wider interval between the layers. Because a temperature region for appearing the colors is above melting point of the PTFE crystal, the PTFE ultra high strength fiber indicates high polymer liquid crystal properties in a range of relaxation time until it becomes completely random by thermal derangement.

Regarding to the drawing speed, the maximum allowable value was not determined because of restriction in capacity of available apparatus, but generally speaking, the faster the better, and a drawing speed at least 50 mm/sec is necessary. The drawing ratio depends on diameter of free end annealed monofilament before the drawing and, in a case of 0.4–0.5 mm in diameter of the monofilament after paste extrusion, at least 5000% (50 times), preferably at least 7500% (75 times) is necessary. Limit drawing ratio depends on a thermal treatment condition, especially cooling conditions such as cooling speed and a range of temperature for control under a constant cooling speed. However, preferable results both in elastic modulus and strength can be obtained only by super drawing with the limit drawing ratio. The above limit drawing ratio is a low level in comparison with the level of 100–300 times in case of the super drawing for ultra high molecular weight polyethylene. One of the reasons is assumed that the PTFE molecule is a high polymer belonging to an intermediate type between the bending chain type and rigid straight chain type. Naturally, if the reduction ratio, RR, in the paste extrusion process for the PTFE is considered, an effective drawing ratio for the PTFE is equal to or more than the drawing ratio for polyethylene.

Another important condition for the super drawing is immediate cooling by taking out from the thermostat after the drawing. The cooling condition can be air-cooling, but a condition close to the quenching condition is preferable. After completion of the super drawing, contacting the obtained fiber to the drawer which keeps still a sufficiently high temperature must be avoided. If the fiber contacts to the warm drawer, orientation of the molecules changes back to the original one, and strength of the fiber decreases remarkably.

Accordingly, manufacturing of ultra high strength fiber of PTFE having an orientation of molecular chains in a fiber axis direction can be achieved by the steps of making monofilament with billets of PTFE group polymer through a paste extrusion process, treating the monofilament thermally in a free end condition, cooling gradually, and drawing the monofilament. The orientation of the molecular chains has an advantage to increase the strength of the fiber to at least 0.5 GPa. Conclusively, in the case of PTFE, the super drawing and a high grade molecular orientation by the super drawing are easily achievable, and a preferable modulus of elasticity can be obtained by methods other than the present invention (for instance, heat treatment in a condition other than the free ends condition) as far as the above molecular orientation is achieved. However, it was found that the strength of the fiber at least 0.5 GPa could not be obtained stably if the fundamental conditions claimed in the present invention were not satisfied.

DETAILED DESCRIPTION OF THE EMBODIMENTS

Figure 1:
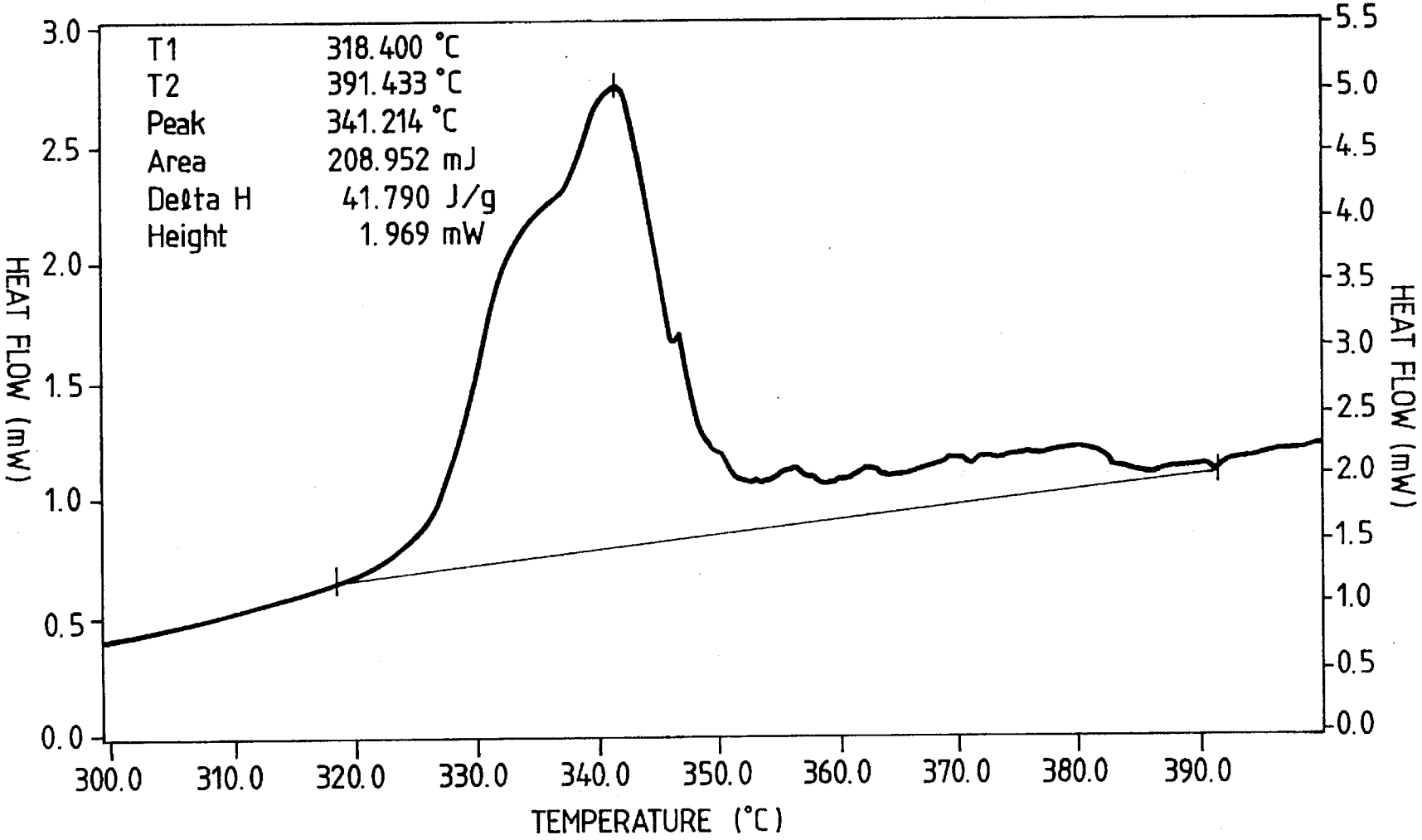
FIG. 1 is a graph indicating a DSC (Differential Scanning Calorimetry) of PTFE high strength fiber.

Embodiments of the present invention are explained hereinafter in detail.

Embodiment 1

Polyfuron TFE F-104 (made by Daikin Industries Co., PTFE fine powder) was sieved with 4 mesh, 8.6 mesh, and 16 mesh sieves orderly. Subsequently, 50 grams of the Polyfuron was weighed with a balance, and put into a jar made of glass with a sealing plug. Then, 15 cc (23.4 phr.) of Isoper-M (made by Esso Chemicals Co., Specific density 0.781) was added drop by drop to the PTFE powder in the jar at a middle of the concave shaped PTFE powder as a lubricant. After sealing the jar with the plug, the jar was shaken lightly with hands for 1–2 minutes, and further, contents in the jar were mixed by rotating the jar in a circumferential direction with a speed of 20 m/min. for 30 minutes on a rotating apparatus. Subsequently, after leaving the jar still at a room temperature for 16 hours, a cylindrical billet of 10 mm diameter and 25 mm long was fabricated with the wet PTFE powder by a pressing machine. The fabricating condition was at a room temperature, and 1 $kg/cm^2 \times 1$ minute. The cylindrical billet was extruded to form a monofilament of 0.4 mm diameter by a Shimazu flow tester CFT-500. The extrusion condition was 60° C.×500 kgf, and the RR was about 800. The PTFE monofilament was thermally treated (Free ends annealing) with a condition of 350° C.×1.5 hours by a programmed thermostat. After cooling the monofilament with a speed of 0.5° C./mm to 150° C., the monofilament was taken out from the apparatus in the room temperature.

Then, after the free ends annealed monofilament was heated at 387°–388° C. for five minutes in a thermostat furnished with a drawer, the monofilament was drawn 7500% with a drawing speed of 50 mm/sec. at the above temperature. Immediately after the drawing, the monofilament was taken out from the apparatus into the air and maintained at the room temperature for five minutes, and the monofilament was got rid of chucks. Ten PTFE super drawn fibers were made by the same method as above. Diameters of the ten fibers (NO. 1–10) were in a range of 31–49 μm as shown in Table 1. Subsequently, strengths of the fibers at a middle portion were determined at 23° C. with a pulling rate of 20 mm/min. on TW (tensile load) and TS (tensile breaking stress). The result is shown in Table 1.

TABLE 1

| No. | Diameter [μm] | TW [kgf] | TS [kgf/mm²] | TS [GPa] |
|---|---|---|---|---|
| 1 | 46 | 0.36 | 217 | 2.12 |
| 2 | 41 | 0.38 | 288 | 2.82 |
| 3 | 36 | 0.205 | 202 | 1.97 |
| 4 | 36 | 0.235 | 231 | 2.26 |
| 5 | 31 | 0.20 | 265 | 2.60 |
| 6 | 46 | 0.30 | 180 | 1.77 |
| 7 | 33 | 0.205 | 240 | 2.35 |
| 8 | 40 | 0.23 | 183 | 1.79 |
| 9 | 39 | 0.23 | 192 | 1.89 |
| 10 | 49 | 0.30 | 159 | 1.56 |

The strength of all the fibers were larger than 1 GPa as shown in Table 1. An average of diameters of the fibers was 39.7 μm diameter, and an average strength of the fibers was 2.11 GPa. A DSC (Differential Scanning Calorimetry) of the PTFE ultra high strength fiber is shown in FIG. 1. The DSC indicates thermal absorption in a chart of differential thermal analysis. Therefore, from the result shown in FIG. 1, it is revealed that the melting point (326°–327° C.) of sintered PTFE increases to 341° C. by making a monofilament into an ultra high strength fiber, and further, a wide range of thermal absorption trail which is characteristic of the ultra high strength fiber and can not observed for the sintered PTFE is spread from 350° C. to 390° C.

Embodiment 2

Monofilament of 0.5 mm diameter were fabricated using the same materials and apparatus as the embodiment 1 except only wet PTFE having a different blending ratio, i.e. PTFE 100 grams and Isoper-M 20 phr with a RR of 510. Subsequently, FEA monofilament were obtained by the steps of air-cooling the monofilament immediately after FEA at 350° C.×30 minutes, further performing FEA at 350° C.×1 hour, and cooling with a speed of 5° C./min. to 150 ° C. The obtained FEA monofilament were drawn 7500% at 388° C. with 50 mm/sec. to form the PTFE fibers. As the result, although diameters of the filaments fluctuated within a range of 30–97 μm diameter, even the fiber having the most thinner diameter of 30 μm diameter had a strength of 4.16 GPa. The observed value equals to the same strength as the top data 6.2 GPa for ultra high strength fiber of super high molecular weight polyethylene (assuming a molecular cross section of polyethylene as 18.22) in consideration of the molecular cross section of PTFE as 27.32.

Further, other strength in the present embodiment were respectively 1.73 GPa (diameter 48 μm), 1.18 GPa (diameter 77 μm), and 1.34 GPa (diameter 52 μm), and all of the fibers having the diameters at most 77 μm had strengths at least 1 GPa.

Embodiment 3

Billets were made of wet PTFE using the same materials, blending ratio, apparatus, and fabricating condition as the embodiment 1, raw monofilament of 0.4 mm diameter were fabricated by paste extrusion of the billets with a RR of 800, and the raw monofilament were thermally treated at 350° C. for 1.5 hours. Subsequently, the monofilament were prepared with the following conditions;

(1) Heat treatment: A condition allowing free shrinkage (FERA) and another condition wherein both ends of the monofilament of 250 mm long are fixed with a chuck having a 200 mm span with a 25% slack (as a shrinking fraction in a free shrinkage by air-cooling is about 22%, this condition can be regarded as a kind of FEA, but the condition is called hereinafter as SEA, Set End Anneal).

(2) Cooling speed: 0.5° C./min. 5.0° C./min. 10° C./min., and rapid cooling (taken out from the apparatus into air immediately after completion of the heat treatment).

(3) A temperature range for controlling the cooling speed constant: (A) 350°–120° C., (B) 350°–275° C., (C) 320°–275° C., and (D) 350°–150° C.

The monofilament thermally treated with the above conditions were preheated at 387°–388° C. for 5 minutes in a thermostat furnished with a drawer, and subsequently, the monofilament were super drawn at the same temperature as the preheating with drawing speed of 50 mm/sec. to obtain super high strength fibers (UHSF). Tensile strengths of the obtained UHSF were determined with the same condition as the embodiment 1 (an average of the total number of the samples, n=10). The result is shown in Table 2. Further, DSC were determined on both the heat treated monofilament and the UHSFs. Crystallinity was calculated from fusion enthalpy assuming the fusion enthalpy of perfect crystal of PTFE is 93 J/g, and the result is shown concurrently in Table 2.

TABLE 2

| Heat treatment condition | | | | | | | |
|---|---|---|---|---|---|---|---|
| | Cooling speed | | Crystallinity | | | UHSF Characteristics | |
| Kind (FEA SEA) | (°C./min.) and temperature range | | Raw monofilament | Heat treatment monofilament | UHSF | Limit drawing ratio $\lambda_{max}$ (times) | Tensile strength TS (GPa) |
| — | — | — | 76.4 | — | — | — | — |
| FEA | 0.5 | A | | 36.8 | 51.1 | 100 | 2.34 |
| | 0.5 | B | | 32.8 | 47.2 | 100 | 1.76 |
| | 0.5 | C | | 30.5 | 41.5 | 100 | 0.94 |
| | 5.0 | D | | 26.8 | 44.0 | 75 | 1.23 |
| | 10 | D | | 23.7 | 42.3 | 75 | 0.87 |
| | Rapid cooling | — | | 23.0 | 42.3 | 75 | 0.81 |

TABLE 2-continued

| Heat treatment condition | | | | | | | |
|---|---|---|---|---|---|---|---|
| | Cooling speed | | Crystallinity | | | UHSF Characteristics | |
| Kind (FEA SEA) | (°C./min.) and temperature range | | Raw monofilament | Heat treatment monofilament | UHSF | Limit drawing ratio $\lambda_{max}$ (times) | Tensile strength TS (GPa) |
| SEA | 0.5 | A | | 31.4 | 40.7 | 100 | 0.83 |
| | 0.5 | B | | 34.0 | 39.4 | 100 | 0.75 |
| | 0.5 | C | | 29.6 | 38.9 | 100 | 0.56 |

According to the result, the crystallinity of the heat treated monofilament and the UHSF have a relationship, and further, a relationship can be recognized between the crystallinity and the strength of the UHSF. Furthermore, it is revealed that the limit drawing ratio in the super drawing process can be determined by the condition of the heat treatment.

In accordance with the present invention, an advantage to obtain PTFE High strength fiber having a strength at least 0.5 GPA can be achieved.

What is claimed is:

1. High strength fiber of polytetrafluoroethylene produced by free end annealing and subsequent drawing of a monofilament of polytetrafluoroethylene group polymer which is formed by paste extrusion, wherein molecular chains of said polytetrafluoroethylene are oriented to a direction parallel to an axial direction of said fiber, and a thermogram of said polytetrafluoroethylene fiber after said drawing has only one endothermic peak at approximately 341° C. and a substantially flat absorption trail in a temperature range of approximately 350°–390° C.

2. High strength fiber of polytetrafluoroethylene as claimed in claim 1, wherein crystallinity of said monofilament after the free end annealing is at least 26%.

3. High strength fiber of polytetrafluoroethylene as claimed in claim 1, wherein a tensile breaking strength of said polytetrafluoroethylene is in a range from 1 GPa to 4.2 GPa.

4. High strength fiber of polytetrafluoroethylene as claimed in claim 1, wherein said fiber has a diameter ranging from 31 μm to 77 μm.

* * * * *